US005971292A

United States Patent [19]

Roy et al.

[11] Patent Number: 5,971,292

[45] Date of Patent: Oct. 26, 1999

[54] METHOD OF VENTING A FURNACE

[75] Inventors: William J. Roy, Laporte; Ninev K. Zia, Indianapolis; Timothy J. Waterman, Carmel, all of Ind.

[73] Assignee: Carrier Corporation, Syracuse, N.Y.

[21] Appl. No.: 09/099,597

[22] Filed: Jun. 18, 1998

Related U.S. Application Data

[63] Continuation-in-part of application No. 08/810,229, Mar. 3, 1997.

[51] Int. Cl.[6] ..... F24D 5/00

[52] U.S. Cl. ..... 237/53; 126/110 R

[58] Field of Search ..... 237/53; 126/110 R, 126/110 A, 110 B, 110 D, 116 R

[56] References Cited

U.S. PATENT DOCUMENTS

| | | | |
|---|---|---|---|
| 4,160,440 | 7/1979 | Barnickle | 126/110 R |
| 4,261,326 | 4/1981 | Ihlenfield | 126/110 R |
| 4,603,680 | 8/1986 | Dempsey et al. | 126/99 A |
| 4,660,761 | 4/1987 | Bussjager | 237/2 B |
| 5,427,086 | 6/1995 | Brownell | 126/110 R |
| 5,636,993 | 6/1997 | Badry | 454/263 |

OTHER PUBLICATIONS

National Fire Protection Association (NFPA) entitled: NFPA 211 Chimneys, Fireplaces, Vents, and Solid Fuel Burning Appliances, 1992 Edition, section 3–1.9.1; section 3–2.2—Category I Gas Applicances.

International Conference of Building Officials entitled: 1997 Uniform Mechanical Code, section 813.2.

National Fire Protection Association (NFPA) entitled: National Fuel Gas Code, 1996 edition, sections 7.5.1; 7.5.3: 7.5.4.

American Gas Association entitled: International Fuel Gas Code, 1997, sections 501.15.1 and 501.15.2, Table 502(3), pp. 127–128, examples 5B and 5C.

Installation, Start–Up, And Operating Instructions—Upflow Gas–Fired Induced–Combustion furnaces (395CAV Series G) (2 pages).

1993 ASHARE Handbook Fundamentals, Table I.

*Primary Examiner*—Henry Bennett
*Assistant Examiner*—Derek S. Boles

[57] ABSTRACT

An improved furnace is provided which can be field modified to change the pressure drop across the inducer. The pressure drop is modified to accommodate vertical or horizontal venting and adequately lined and inadequately lined chimneys. A first rate of flow of combustion byproducts into the vent system is used when the chimney is adequately lined and a second relatively higher rate of flow is used when the chimney is inadequately lined. The rate of flow is changed by inserting or removing an obstruction in the flow of combustion byproducts. The obstruction could be a tab or choke placed at the inducer outlet or a similar device in the inducer inlet. When the tab is in place the flow of combustion byproducts is reduced. When the tab is removed, the flow rate increases. Alternatively, the inducer inlet could be adjusted to increase or decrease the amount of air flow through the inducer.

2 Claims, 10 Drawing Sheets

METHOD OF VENTING A FURNACE

This application is a Continuation-In-Part, of Application Ser. No. 08/810,229, filed Mar. 3, 1997.

BACKGROUND OF THE INVENTION

1. Field of the Invention

This invention relates in general to a method of venting a furnace. More particularly, the invention relates to an improved method of venting a furnace which allows for field modification of the furnace depending on the type of installation required.

2. Discussion of the Related Art

In conventional gas-fired forced air furnaces a thermostat senses the temperature in the comfort zone relative to a predetermined set point temperature. When the temperature is below the set point, the thermostat closes to supply thermostat ac power to the furnace as a call for heat. This initiates a sequence of events that ultimately causes the furnace to come on. An inducer motor is enabled to flow air through the heat exchangers for combustion, after which a gas valve is actuated to supply gas to the gas burners. An ignition device is also actuated to light the burners. In some furnace designs, a flame sensor then proves burner ignition. Then, after a predetermined blower delay time, which varies with furnace design, the furnace blower is actuated. The blower circulates room air from the return air duct over the furnace heat exchangers to pick up heat from the hot combustion products (carbon dioxide, nitrogen, oxygen, excess air and water vapor). The heated circulating air then goes into the supply air plenum and is distributed by ductwork back to the living space. When the living space is warmed sufficiently to reach the thermostat set point, the thermostat terminates the call for heat. When this happens, the blower and burners go through a shut off sequence and the furnace awaits the next call for heat.

After passing through the heat exchanger, the combustion byproducts are vented outside of the structure through a vent pipe. The vent pipe can be oriented either predominantly horizontally through a side wall of the structure or predominantly vertically through the roof of the structure. When the inducer motor is in operation, a substantial step-up in pressure occurs between the intake of the inducer housing (the collector box) on the one hand, and the outflow of the inducer housing (the relief box) on the other hand. Typically there is negative pressure (relative to atmospheric pressure) at the intake. The pressure at the outlet of the inducer housing is slightly negative for conventional vertical vent systems, and substantially positive for horizontal side vent systems.

One problem with furnaces in the past is that with a horizontally vented furnace, the furnace is affected by wind conditions such that under certain outside conditions, such as high wind conditions, back pressure can cause the inducer to become overloaded. However, a vertically vented furnace is not affected as much by wind conditions because of the buoyancy of the heated air and the angle of incidence of wind on the vent termination. In order to minimize the decrease in pressure drop across the inducer caused by wind in a horizontally vented furnace and improve wind resistance, the pressure drop across the inducer must be great enough to offset the back pressure.

A second problem with furnaces of the past relates to condensation in the chimney. In a vertically vented furnace, based on geographic location, furnace input, and liner interior dimension, the chimney can either require relining, if it is inadequately lined or be adequately lined. The lining can be a tile liner or a pipe inserted into the chimney. Unlined chimneys are more susceptible to damage (i.e. spalling and cracking when exposed to freezing conditions) caused by condensation in the chimney. Condensation is more likely to form in the chimney with more efficient contemporary furnaces. This occurs because the flue gasses are relatively cooler in a higher efficiency furnace than in a lower efficiency furnace and because the amount of excess air in higher efficiency furnaces is reduced. The cooler, reduced mass flow of flue gasses is more likely to condense water vapor on chimney walls and is less able to dry the walls during operation. In a lower efficiency furnace, less heat is transferred to the room air, causing the flue gasses to be warmer. Past lower efficiency designs also had greater amounts of excess air in the vent system. The warmer, higher mass flow of flue gasses removes more moisture from the chimney walls. Thus, in the past, when installing a high efficiency furnace with an unlined or inadequately lined chimney, a liner would have to be installed in the chimney, increasing the cost of the installation. Prior to the time the furnace is installed, it is not known whether the chimney will be lined or unlined.

SUMMARY OF THE INVENTION

An apparatus is provided for field modifying a furnace to change the pressure drop across the inducer and to modify the excess air flow to accommodate vertical or horizontal venting and adequately lined chimneys or those otherwise requiring relining. The furnace is adapted to deliver heated air to a building and to deliver combustion products outside of the building. As is known, the furnace includes a heat exchanger and an inducer motor for drawing combustion products through the heat exchanger at a desired rate of flow. The inducer motor is in an inducer housing which has an inlet for receiving combustion products and an outlet for discharging combustion products. A vent pipe is connected to the furnace to carry combustion products outside of the building. In one embodiment, a chimney is connected to the vent pipe and is adapted to vent the combustion products of the furnace. The chimney is either adequately lined or inadequately lined. In a second embodiment, the combustion products are vented either horizontally or vertically. Means are provided for changing the rate of flow of combustion products through the heat exchanger to provide a first rate of flow of combustion products when the chimney is adequately lined and a second relatively higher rate of flow when the chimney is inadequately lined or to provide a first rate of flow when the furnace is vented vertically and a second rate of flow when the furnace is vented horizontally. The rate of flow is changed by inserting or removing an obstruction in the flow of combustion products. The obstruction could be a choke placed at the inducer outlet. When the choke is in place the flow of combustion products is reduced. When the choke is removed, the flow rate increases. Alternatively, the inducer inlet could be modified to increase or decrease the amount of air flow through the inducer. Other means for changing the air flow and the efficiency of the furnace are available.

These and other details, advantages and benefits of the present invention will become apparent from the detailed description of the preferred embodiment hereinbelow.

BRIEF DESCRIPTION OF THE DRAWINGS

The preferred embodiment of the invention will now be described, by way of example only, with reference to the accompanying Figures wherein like members bear like reference numerals and wherein.

DETAILED DESCRIPTION OF A PREFERRED EMBODIMENT

Figure 1:
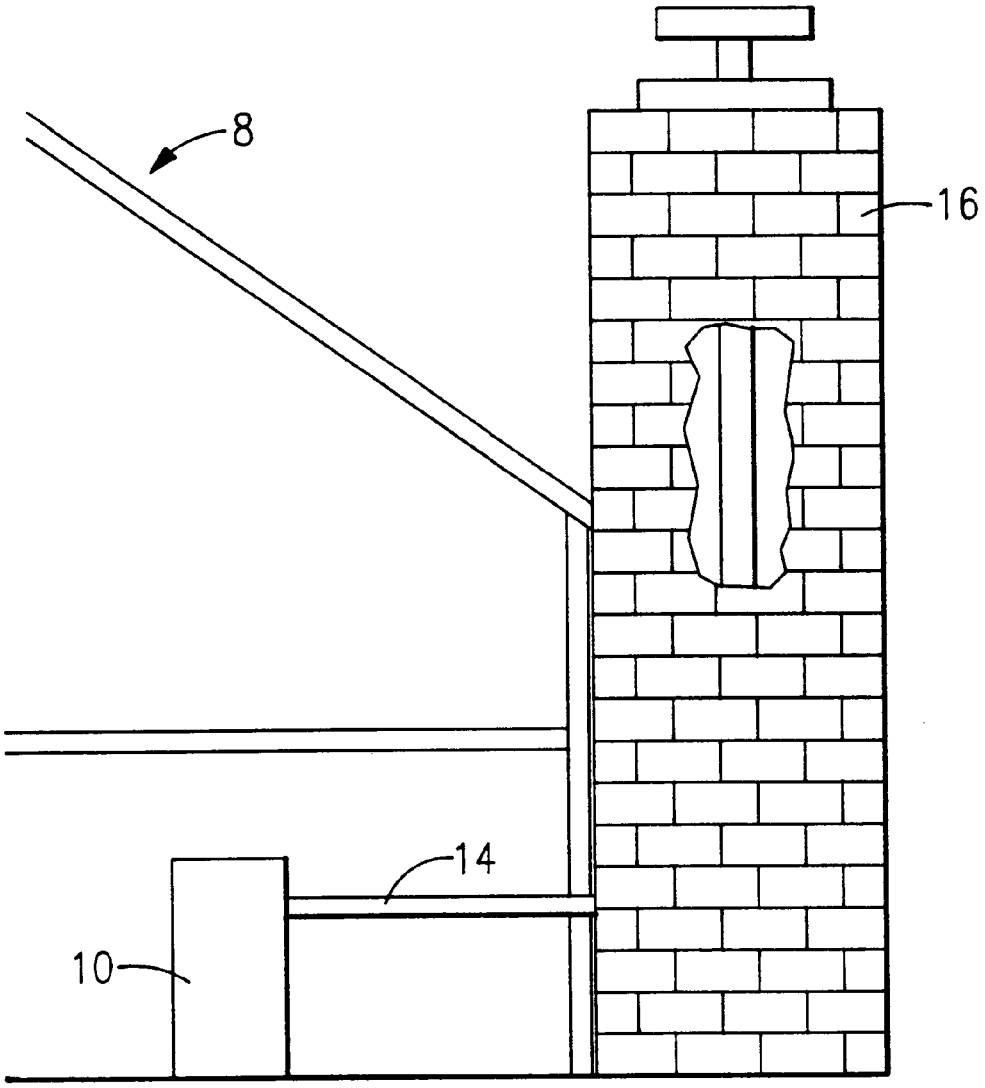
FIG. 1 is a diagrammatic view of a furnace vented through a chimney.

Referring now to the drawings, which are for the purpose of illustrating the preferred embodiment of the invention and not for the purpose of limiting the same, FIGS. 1–16 show a furnace including the present invention.

Figure 2:
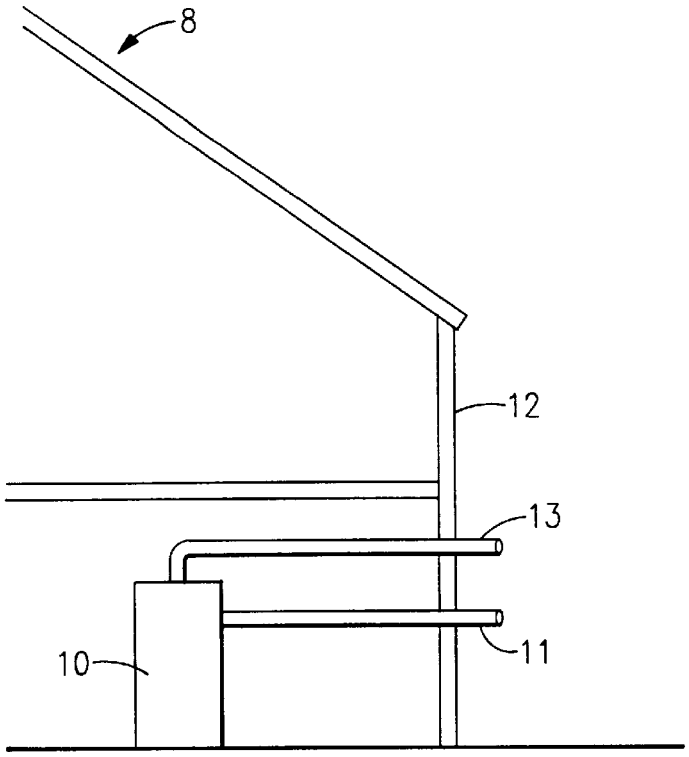
FIG. 2 is a diagrammatic view of a furnace having horizontal venting.
Figure 3:
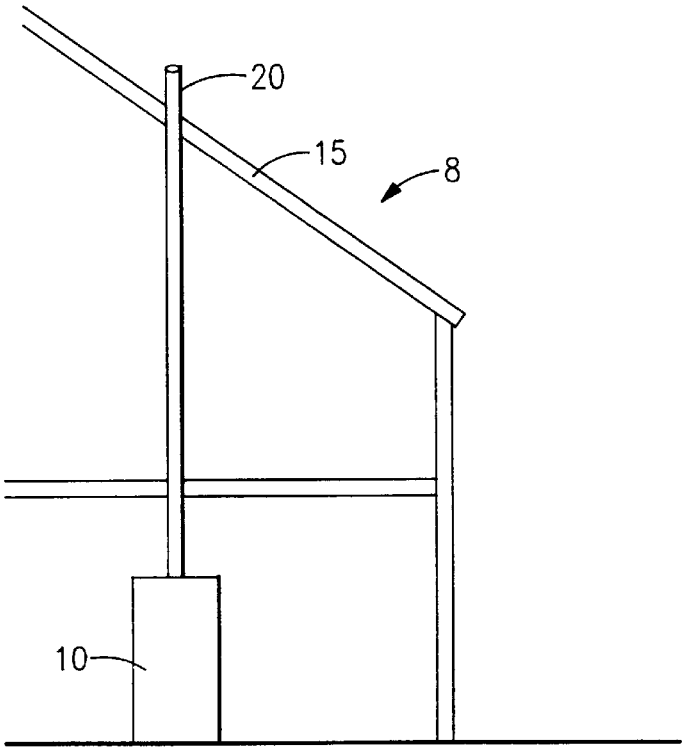
FIG. 3 is a diagrammatic view of a furnace having vertical venting.
Figure 5:
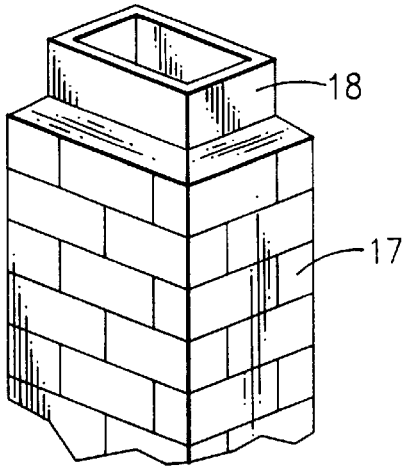
FIG. 5 is a perspective view of a chimney with a tile liner.
Figure 7:
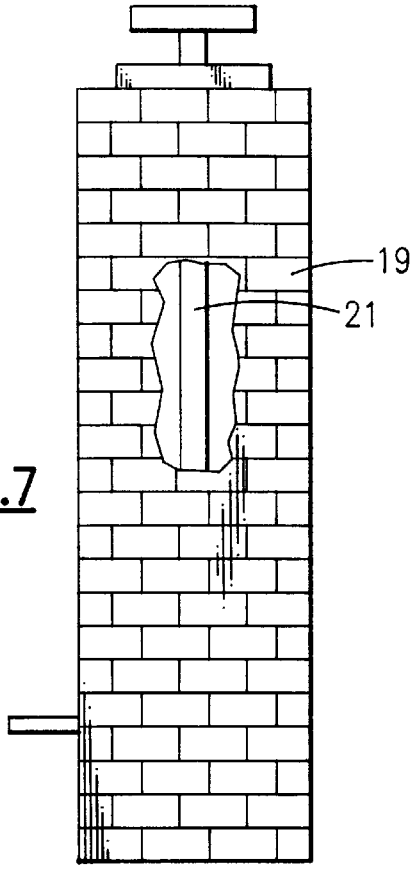
FIG. 7 is a partially cut away front view of a tile lined chimney having an added metal liner therein.
Figure 6:
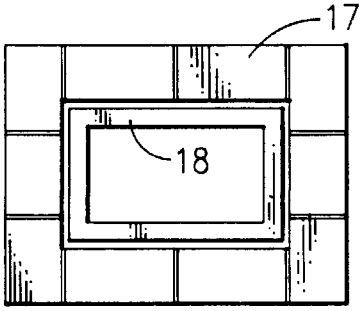
FIG. 6 is a top view of the chimney in FIG. 5.
Figure 4:
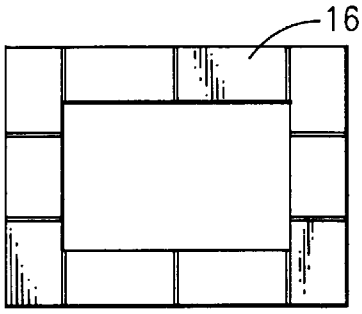
FIG. 4 is a top view of an unlined chimney.

The furnace can be any conventional gas or oil fired furnace. FIG. 1 shows a house 8 with a furnace 10. The furnace 10 has a vent pipe 14 connected to a chimney 16 to direct combustion products outside of the house 8. FIG. 2 shows the furnace 10 with a horizontal vent 13 to direct combustion products outside of the house 8 through wall 12. In this configuration, it is also possible to use an air intake pipe 11 (as is known in the art). FIG. 3 shows the furnace 10 with a vertical vent pipe 20 through the roof 15 of the house 8. When the furnace 10 is vented through a chimney, the chimney 16 can be unlined, as shown in FIG. 4 or the chimney could be tile lined, as shown in FIGS. 5 and 6. FIG. 5 shows a chimney 17 with a tile liner 18. FIG. 7 shows a chimney 19 relined with a metal liner 21 inside the chimney 19.

In accordance with one embodiment of the invention, it is necessary to make a determination as to whether or not the chimney is adequately lined or inadequately lined. For that purpose there are various industry standards and guidelines that have been published and are available for application by an installer of a furnace containing the invention. For example, in a National Fire Protection Association (NFPA) publication entitled: *NFPA* 211 *Chimneys, Fireplaces, Vents, and Solid Fuel Burning Appliances,* 1992 edition, section 3-1.9.1 discusses the relining of chimneys so as to resist corrosion, softening or cracking from flue gasses. Section 3-2.2 and after discusses various materials and classes of chimney service, including Category I Gas Appliances, in which a gas furnace of the present invention would fall. An International Conference of Building Officials publication entitled: 1997 *Uniform Mechanical Code* provides in section 813.2, various requirements for venting into masonry chimneys. Another NFPA publication entitled: *National Fuel Gas Code,* 1996 edition, discusses various standards and refers to local building codes in sections 7.5.1; 7.5.3; and 7.5.4. An American Gas Association publication entitled: *International Fuel Gas Code,* 1997 provides in sections 501.15.1 and 501.15.2, the requirements for resizing and the use of a flue liner. In Table 502(3), a sizing chart is provided to determine whether the chimney is adequately lined for a given appliance. On pages 127 and 128, examples 5B and 5C, there are shown examples of venting situations where it is determined whether or not a chimney is adequately lined. Finally, a publication entitled: 1993 *ASHARE Handbook Fundamentals,* Table I shows various venting requirements as a function of geographic location.

The above described standards, which are incorporated herein by reference, are widely accepted and used in the industry such that any qualified installer of furnaces would, in applying these standards, make an objective determination as to whether a chimney is "adequately lined" or "inadequately lined" for the proper venting of a furnace. Thus, depending on such things a geographic location, size of chimney, number of appliances connected to the chimney, and number of sides exposed to the outside, an unlined masonry chimney will generally be considered "inadequately lined". Conversely, depending primarily on size and geographic location, a chimney having a metal liner will generally be considered to be "adequately lined". A masonry chimney having a clay tile liner may be determined to be "adequately lined" or "inadequately lined", depending on the chimney structure, geographic location, application and type of furnace installed, with such determination be made by applying the above described standards.

Figure 8:
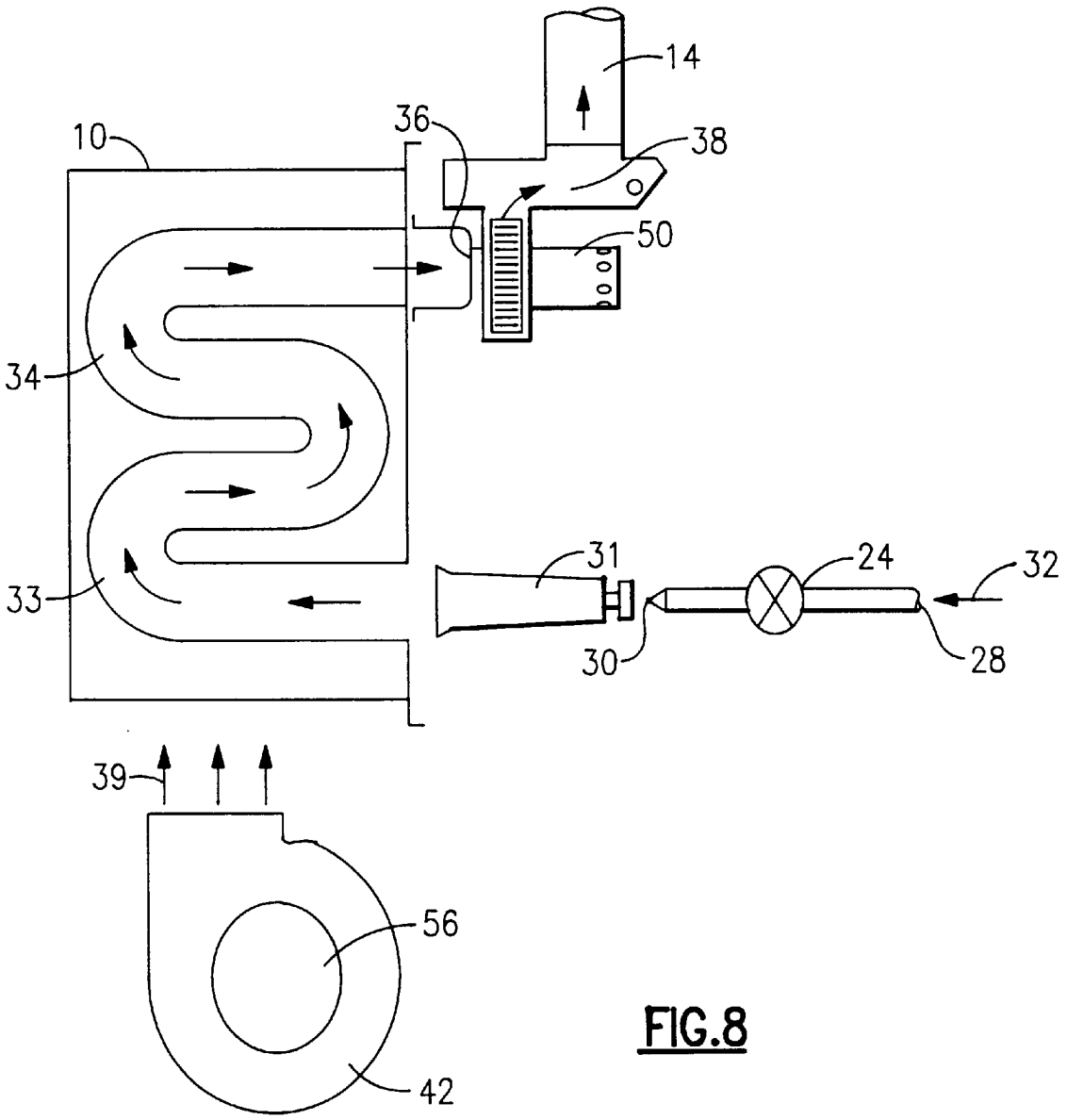
FIG. 8 is a diagrammatic view of a furnace.

As shown in FIG. 8, the furnace 10 includes a gas valve 24 which receives gas from an external source. The gas valve 24 includes an inlet port 28 and an outlet port 30. Gas, represented by arrows 32, flows through the valve 24 and outlet port 30 to the burners 31. The gas is ignited at the outlet of the burners 31 and produces hot combustion products, represented by the arrows 33. The hot combustion products 33 are drawn through heat exchangers 34 by the inducer 50. The inducer 50 has an inlet 36 and an outlet 38. The hot combustion products 33 then pass through the vent pipe 14 to the chimney 16 (FIG. 1). Room air, represented by arrows 39 is forced over the heat exchangers 34 by the blower 42. The room air 39 passes over the heat exchangers 34 to pick up heat from the heat exchangers 34 to warm the room air 39.

Figure 9:
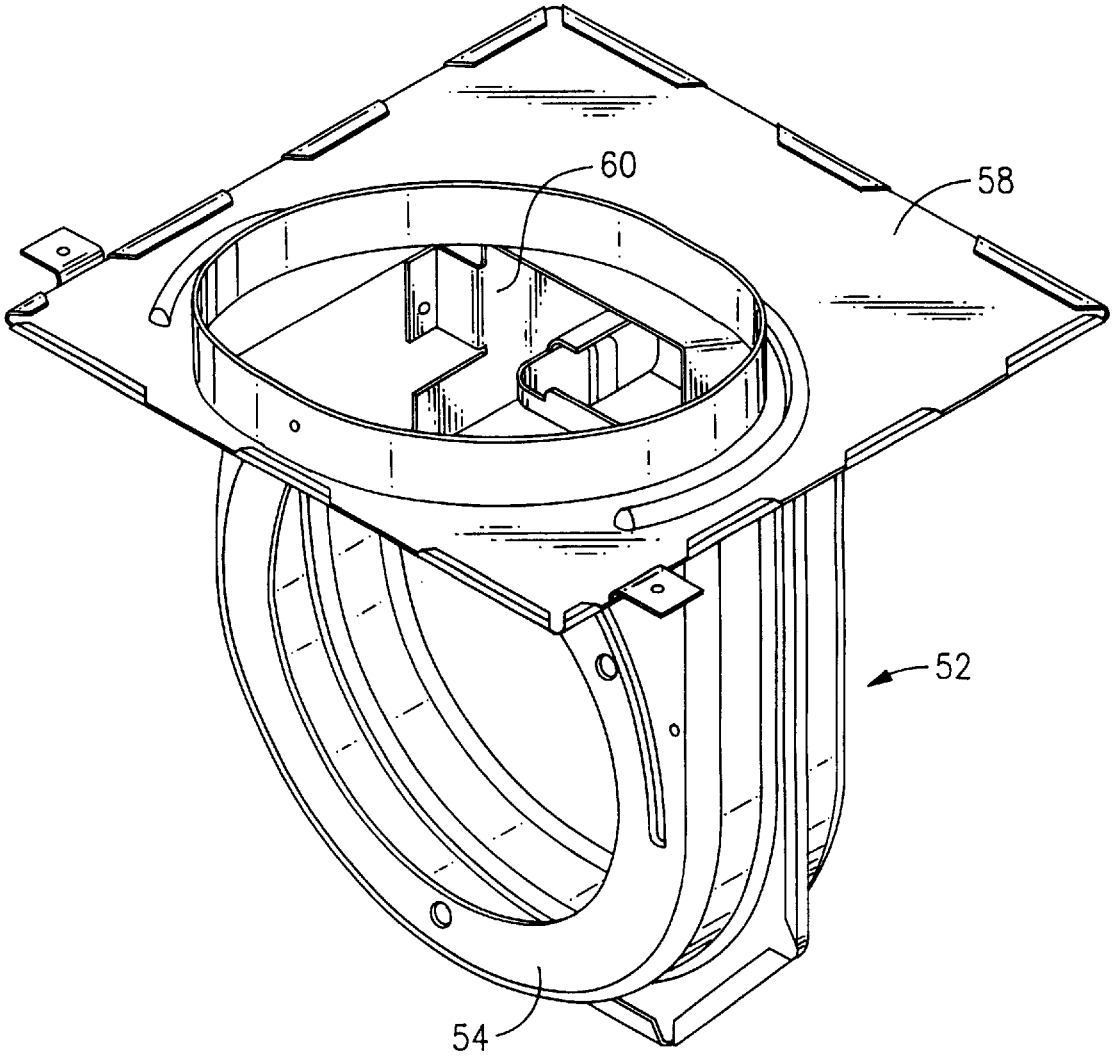
FIG. 9 is a perspective view of the inducer housing of the present invention.
Figure 10:
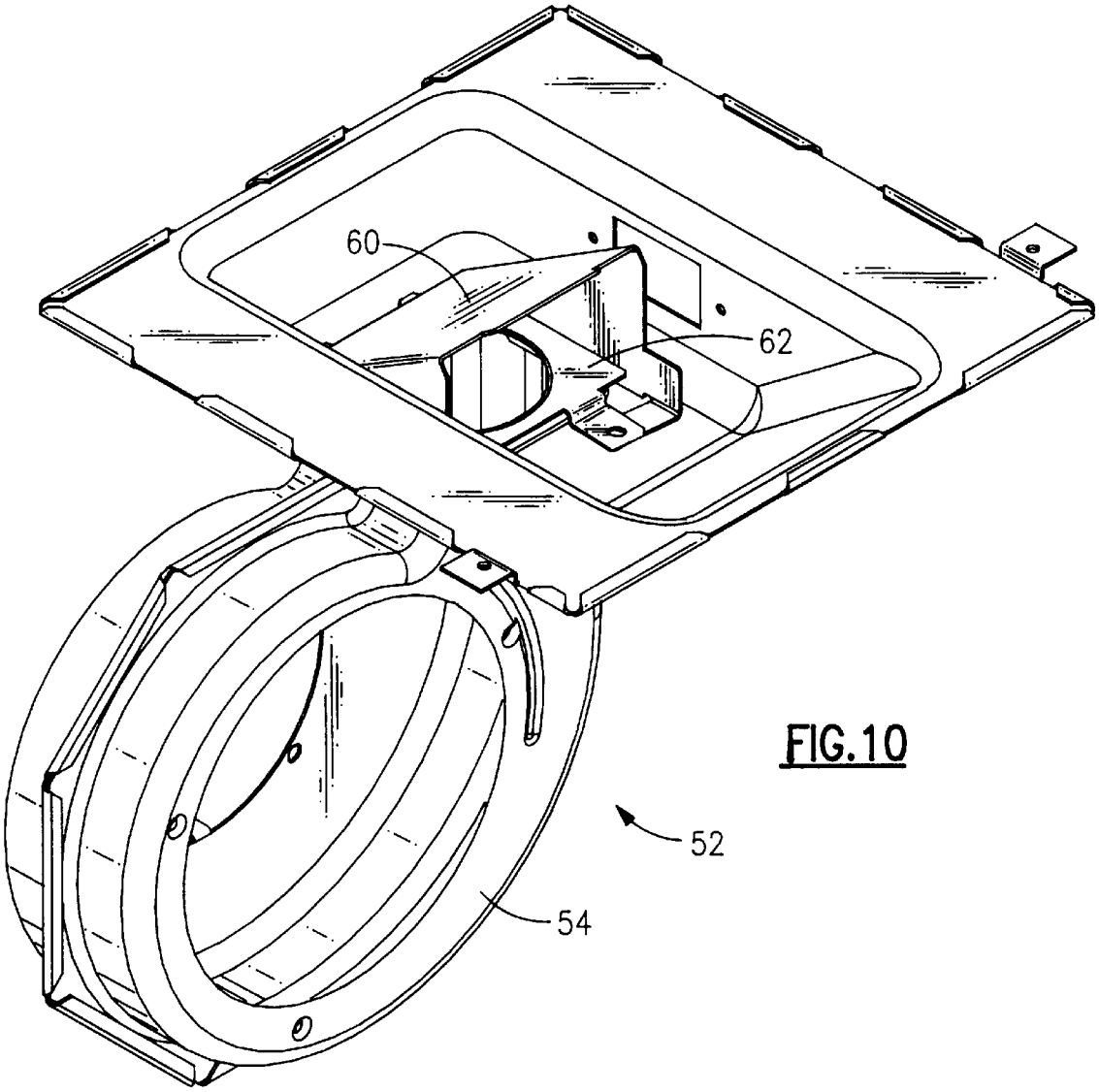
FIG. 10 is a partial cut-away view of the inducer housing of the present invention showing a choke in the inducer outlet.
Figure 10A:
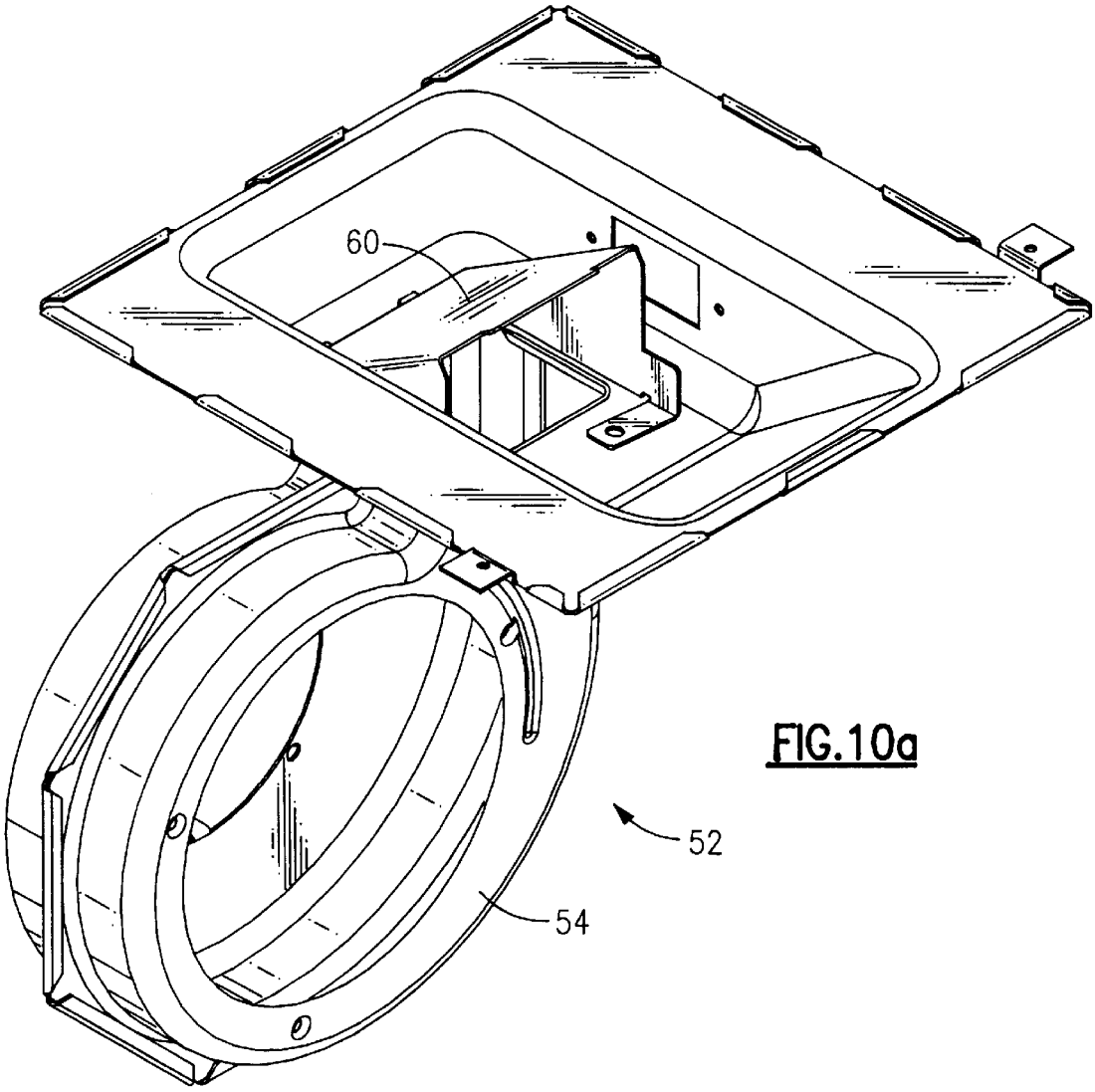
FIG. 10*a* is a partial cut-away view of the inducer housing of the present invention without the choke in the inducer housing.
Figure 11:
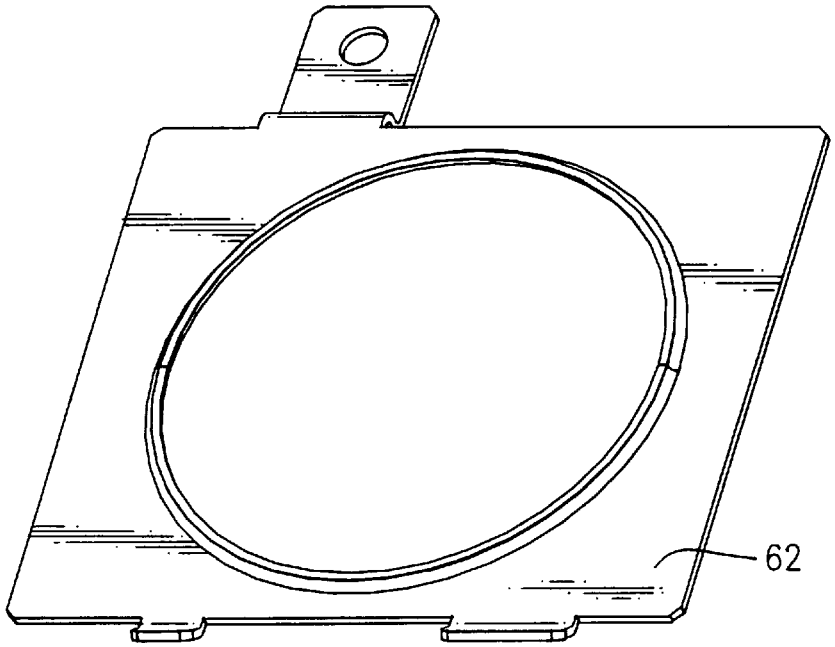
FIG. 11 is a perspective view of the choke of the present invention.
Figure 12:
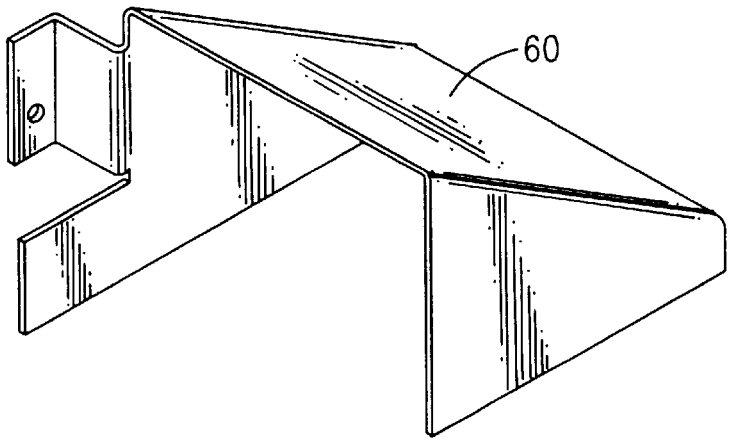
FIG. 12 is a perspective view of the baffle of the present invention.

The inducer 50 is disposed within a housing 52 shown in FIG. 9. The housing 52 includes a mounting surface 54 for holding the inducer 50 in place. The housing 52 also includes a flange 58 for mounting vent 14 to the housing 52. Between the mounting surface 54 and the flange 58 is a baffle 60 for directing the air flow from the inducer 50 to the vent 14. The baffle 60 as shown in FIGS. 10*a* and 12 allows for unrestricted air flow from the inducer 50 to the vent 14. Alternatively, a choke (FIG. 11) can be added (FIG. 10) for reduced flow rate. The choke 62 decreases the mass flow of excess air. Choke 62 will, therefore, increase the efficiency of, and decrease the mass flow of dilution air in, the furnace 10 and decrease the temperature of the combustion products 33 passing through the vent 14.

Figure 13:
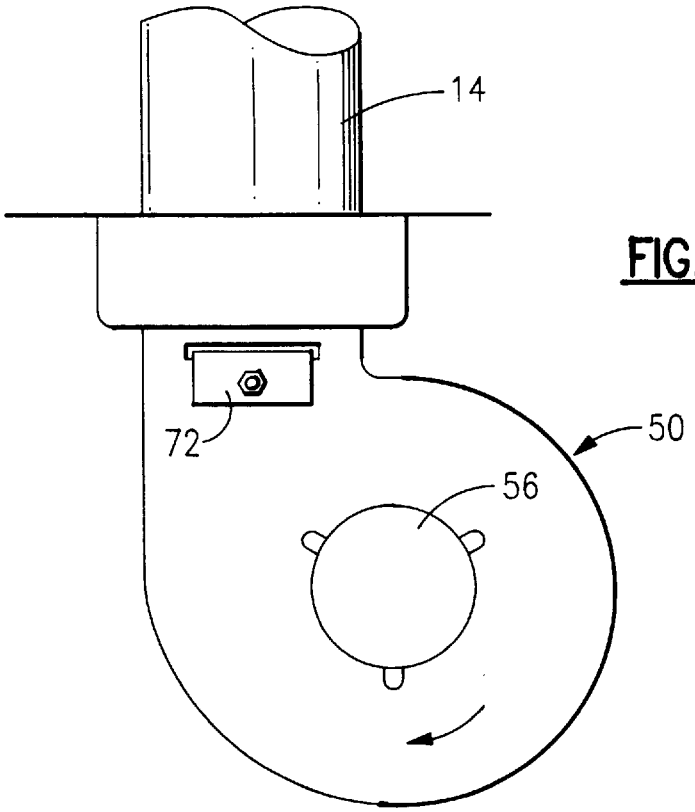
FIG. 13 is a front view of the inducer housing of the present invention including a tab obstruction.
Figure 14:
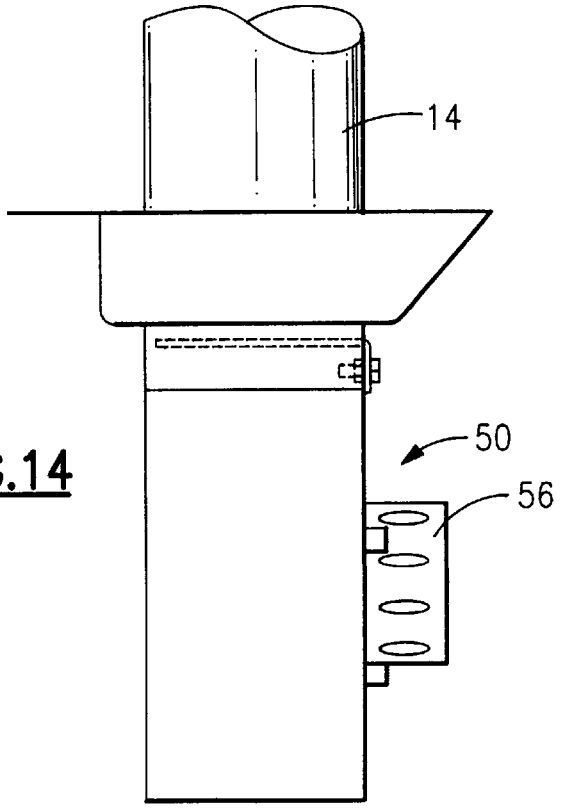
FIG. 14 is a side view of the inducer housing of the present invention including a tab obstruction.
Figure 15:
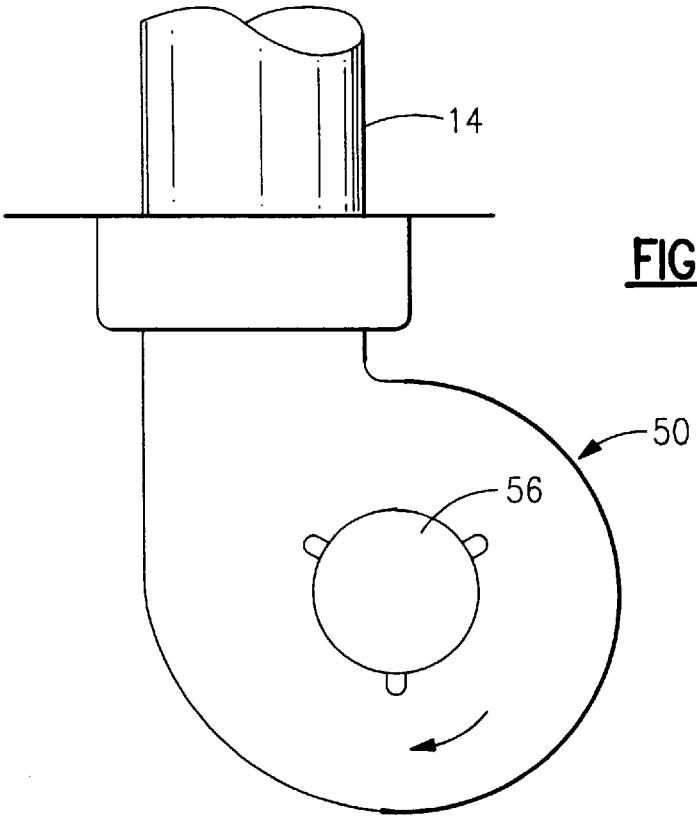
FIG. 15 is a front view of the inducer housing of the present invention without a tab obstruction.
Figure 16:
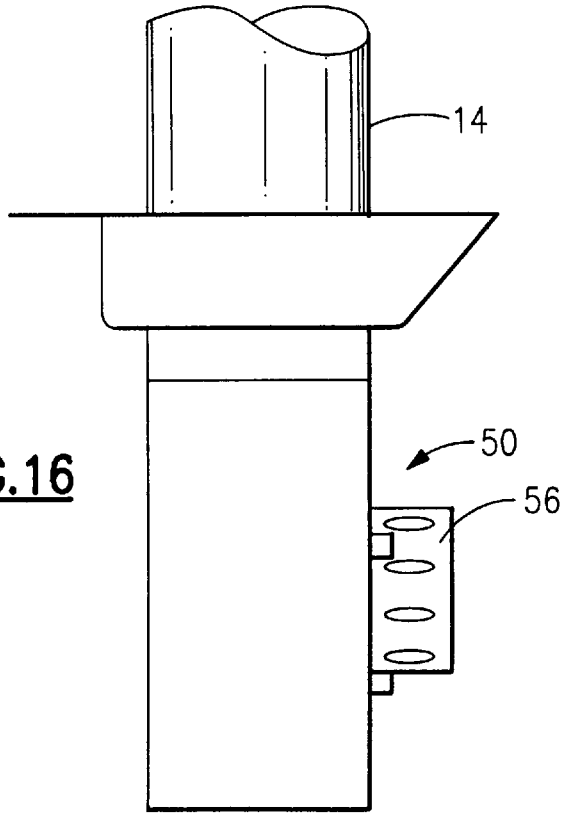
FIG. 16 is a side view of the inducer housing of the present invention without a tab obstruction.

FIGS. 13 and 14 show the inducer 50 with a vent pipe 14. A tab 72 is placed in the vent pipe 14 to reduce the amount of excess air drawn into vent system 14. FIGS. 15 and 16 show the inducer 50 with the tab 72 removed. In this configuration, the amount of excess air drawn into vent system 14 is increased. The increased flow of combustion products and dilution air results in a furnace having a lower efficiency and the combustion products being proportionately higher from the flue gas condensation or dew temperature. Other ways of changing the air flow When the fur such as modifying the inducer air inlet (not shown).

When the furnace is to be vented through the chimney, the install of the furnace determines whether the chimney is adequately lined or would otherwise require relining. If the chimney would otherwise require relining, the installer can avoid costly relining in many geographic areas by removing the obstruction in the flow (tab) to increase the dilution air and the gas temperature above dew point temperature.

When the furnace is to be vented through a vent pipe, the installer determines whether the vent pipe will be horizontal or vertical. If the vent pipe is to be horizontal, the installer removes the obstruction in the flow to increase pressure drop and wind resistance capability.

While this invention has been described in detail with reference to a preferred embodiment, it should be appreciated that the present invention is not limited to that precise embodiment. Rather, in view of the present disclosure which describes the best mode for practicing the invention, many modifications and variations would present themselves to those of skill in the art without departing from the scope and spirit of this invention, as defined in the following claims.

What is claimed is:

1. A method of installing a vented furnace into a chimney which is either adequately lined or inadequately lined, the furnace having an inducer for drawing combustion products through a heat exchanger and discharging them to a vent at a certain flow rate comprising the steps of:

determining whether the chimney is adequately lined or inadequately lined for the particular furnace; and establishing a first rate of flow to the vent if the chimney is determined to be adequately lined and a second higher rate of flow if the chimney is determined to be inadequately lined wherein the second higher rate of flow is established by removing a flow restrictor attached to the inducer.

2. A method of installing a furnace into an enclosure having a chimney and an interconnecting vent pipe which is either substantially horizontal or substantially vertical, the furnace having an inducer for drawing combustion products through a heat exchanger and discharging them to the vent at a certain flow rate comprising the steps of:

determining whether the vent is horizontal or vertical; and establishing a first rate of flow to the vent if the vent is determined to be vertical and a second higher rate of flow if the vent is determined to be horizontal wherein said second high rate of flow is established by removing a flow restrictor connected to the inducer.

* * * * *